United States Patent [19]

Fisher

[11] Patent Number: 5,044,131

[45] Date of Patent: Sep. 3, 1991

[54] FABRIC AWNING ASSEMBLY AND DIVIDER BEAD FOR USE THEREIN

[76] Inventor: Larry M. Fisher, 2316 Piedmond Ridge Ct., Marietta, Ga. 30062

[21] Appl. No.: 525,869

[22] Filed: May 18, 1990

[51] Int. Cl.[5] ..... E04B 1/12

[52] U.S. Cl. ..... 52/63; 52/222; 24/462; 160/392; 160/395

[58] Field of Search ..... 52/63, 222, 466; 160/391, 392, 393, 395, 397, 399, 402; 24/460, 462

[56] References Cited

U.S. PATENT DOCUMENTS

| | | | |
|---|---|---|---|
| 3,508,369 | 4/1970 | Tennison | 52/466 X |
| 4,074,811 | 2/1978 | Filak . | |
| 4,092,992 | 6/1978 | Huddle . | |
| 4,233,790 | 11/1980 | Meadows | 52/222 |
| 4,926,605 | 5/1990 | Milliken et al. | 52/63 |

FOREIGN PATENT DOCUMENTS

| | | |
|---|---|---|
| 2158502 | 5/1973 | Fed. Rep. of Germany . |
| 522798 | 6/1972 | Switzerland . |

OTHER PUBLICATIONS

Bat Accessori document (date unknown, believed to be more than one year before the filing date).

RI.RI documents (date unknown, believed to be more than one year before the filing date).

Astrup Sonair brochure (date unknown, believed to be more than one year before the filing date).

Sunbonnet brochure (date unknown, believed to be more than one year before the filing date).

Declaration of Larry M. Fisher, Exhibits A through H (various dates and origins).

*Primary Examiner*—David A. Scherbel
*Assistant Examiner*—Creighton Smith
*Attorney, Agent, or Firm*—Jones, Askew & Lunsford

[57] ABSTRACT

A fabric awning assembly, method of assembling the same from multiple sections of awning frames, and a novel divider bead for spanning the joint between adjacent sections of awning frames. Staple receiving channels in awning frame extrusions at the end of each section face like channels in adjacent sections so as to facilitate the use of only one divider bead between adjacent sections. The divider beads include protrusions for securing awning fabric within the channels and for protection from pooling moisture. The divider beads, when installed between adjacent sections of fabric awning frames, create the aesthetic impression that the adjacent sections are actually one continuous assembly.

23 Claims, 3 Drawing Sheets

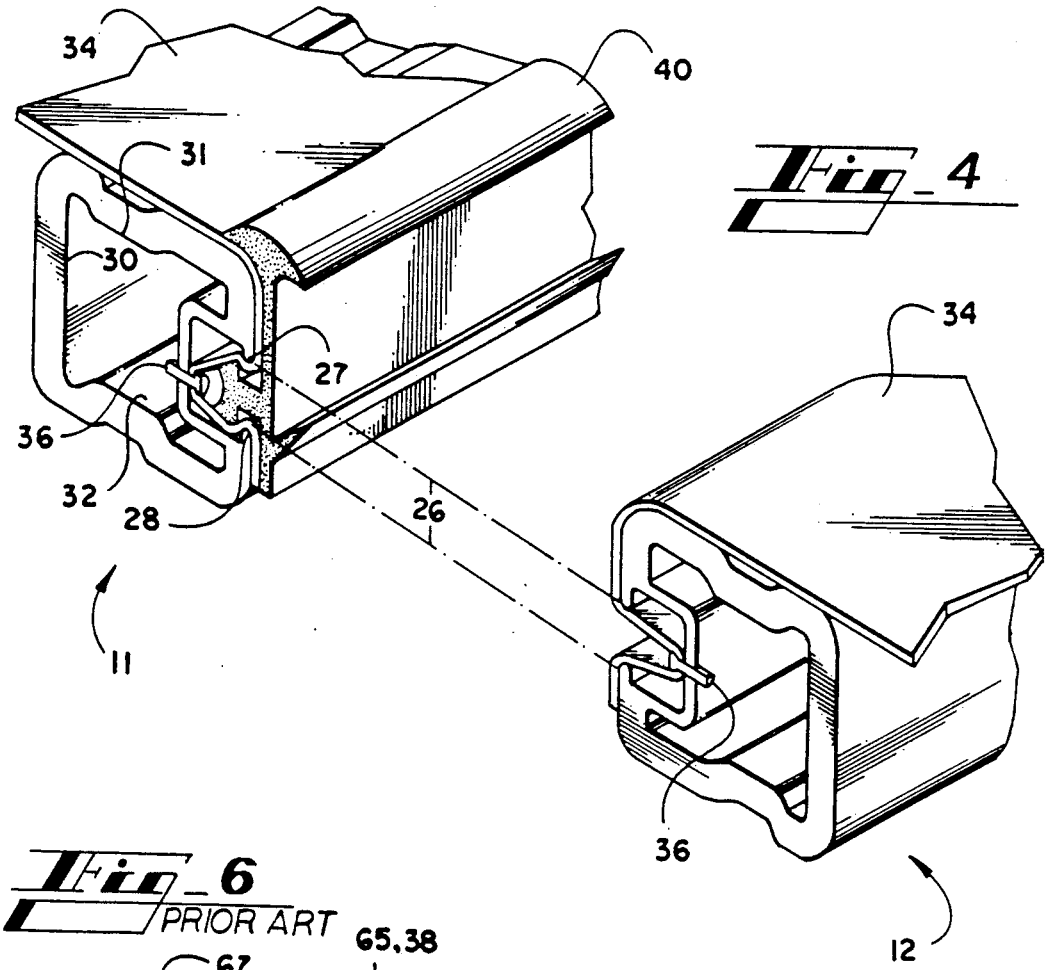
Fig_4
Fig_6
PRIOR ART
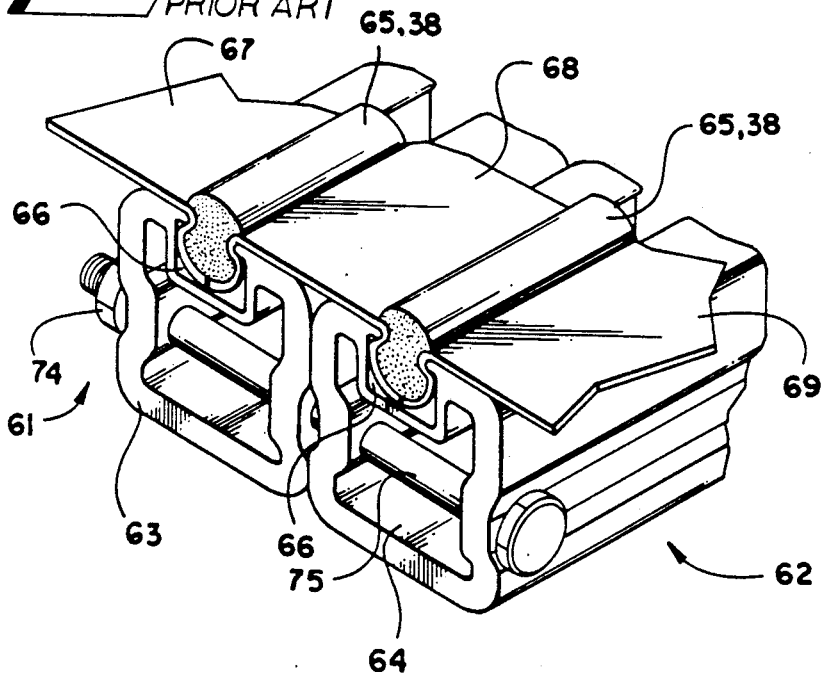

FABRIC AWNING ASSEMBLY AND DIVIDER BEAD FOR USE THEREIN

TECHNICAL FIELD

The present invention relates generally to decorative fabric-covered awning assemblies and relates in particular to a system for joining adjacent sections in an awning assembly and to a divider bead for installation in the gap between the two adjacent sections. The divider bead exhibits aesthetic qualities, eliminates the need for fabric installation at the job site, and prevents moisture from leaking through the awning.

BACKGROUND OF THE INVENTION

In the awning fabrication industry, decorative storefront awnings have conventionally been constructed as follows. Frames of welded aluminum or steel rails or extrusions are built in the factory, in sections that are short enough to safely transport on trucks or trailers to the job site. Once the frame sections are at the job site, they are bolted to a building. In the case where the overall length of the complete awning is longer than an individual section or longer than the truck or trailer used to transport the sections, a plurality of sections are constructed, transported to the job site, abutted to each other, and then bolted or welded to each other so that they become one continuous awning frame assembly of sections.

The cover for the awning frame, usually made of fabric such as polyester or acrylic, is typically also constructed in the shop. The fabric, which is supplied in narrow rolls, is cut into pieces to fit the shape of the awning frame, and the pieces are sewn together into one continuous piece so that the fabric covers the entire awning frame. After the awning frame is bolted to the building, the fabric cover is stretched over the frame and attached thereto, typically with grommets and lacing or by driving screws, staples or other fasteners into the frame.

In some cases, the fabric may be stretched over and attached to an individual awning frame section at the factory and then transported to the job site as a complete covered awning frame section. Then, the sections are typically bolted together as above described to form a continuous awning frame assembly of sections.

Similar methods are followed when a lighted awning is constructed. The fabric used for backlighted awnings is typically a translucent vinyl fabric. Pieces of the translucent vinyl are bonded together by a heat welder to form one piece of cover suitable for attachment to one section of awning frame. As with other awning fabrics, the translucent fabric is attached to the frame with grommets, lacing, or by driving screws into the frame. Again, after two or more sections of covered awning frame are bolted to a building, they are butted up against each other and fastened together with bolts or the like.

More recently, some manufacturers of fabric and lighted awnings have developed and are using an extruded all-aluminum frame which has a channel into which the fabric is attached with steel staples. This method of covering awnings eliminates the need to make patterns, and cut and sew fabric together, to make a one-piece cover for the entire awning or awning section. Instead, aluminum staple-in extrusions are positioned at intervals close enough that a single width of fabric can be stapled on all sides into the frame. Once the fabric or vinyl panels have been stapled into the entire awning frame or awning section, a PVC bead is driven into the stapling channel.

A disadvantage of all of the above-described prior art methods is that there is always a discontinuity at the joints between frame sections. This creates an aesthetically undesirable appearance and also permits the leakage of water between the awning sections.

With the newer staple-in aluminum frame systems, one solution to the section joint problem has been to leave the PVC bead out of the adjoining frame members, until the sections are attached to the building and bolted together. Then, a small strip of fabric is stapled into the adjoining frame members to bridge the seam. Next, two PVC beads are driven into the parallel now-adjacent stapling channels. This leaves the apperance of the overall assembly unbalanced because most regions of the awning only have one PVC bead every several feet, interspersed with regions of two PVC beads close to each other.

Other problems exist with this particular solution. First, two PVC beads are required for each joint between awning frame sections. Second, the installation of the bridging strip of fabric must take place at the job site. Both of these problems increase the cost and decrease the efficiency of the construction of awning assemblies.

Based on these difficulties, there has been a need in the art for a joint between pre-assembled awning frame sections that only requires a single bead and can be easily put together without installing additional fabric at the job site.

SUMMARY OF THE INVENTION

The present invention overcomes the aforementioned problems by providing a divider bead for placement in the joint area between adjacent sections of awning assemblies, and additionally by providing this bead in a manner that permits one bead to be shared by two adjacent sections of awning assembly. The present invention also provides a joint for linking adjacent sections in an awning assembly in a manner that eliminates the necessity for the installation of additional fabric in the gap between the sections.

Generally described, the present invention provides a novel divider bead for insertion in a joint between two adjacent sections of awning frames. The joint is formed by arranging the channels in the aluminum rails at the end of each awning frame in such a manner that the fabric stapling channels face one another. Once this arrangement is completed, the divider bead bridges the gap between the channels at the joint and creates the appearance that the two sections of awning frame are actually part of one continuous assembly.

More particularly described, the preferred embodiment of the the divider bead structure includes an elongate central shank which includes opposite side surfaces, a bottom edge, and a top edge, an elongate top member positioned along the top edge of the shank and extending outwardly beyond the side surfaces of the shank, and two protrusions extending outwardly from the side surfaces of the shank intermediate the two edges of the shank. The two protrusions are preferably a lip extending outwardly from one side surface of the shank at an upward angle of approximately 35 degrees and a support block extending outwardly from the other side surface of the shank. The angular placement of the lip directs moisture away from the channel, thus preventing such moisture from accumulating in the channel and deteriorating both the awning fabric and the staples with which the fabric is attached to the frame. The support block is a generally T-shaped tab which fits into one of the channels and holds the divider bead against one of the rails of the joint, and around which the awning fabric extends when the divider bead is properly positioned between two sections of awning frame.

The present invention also provides a method of constructing an awning assembly. The channels into which the awning fabric is stapled are arranged such that the channels at the periphery of two adjacent awning sections directly face one another. Then, the two sections are positioned on a building with a divider bead between them and extending into one of the facing channels. Preferably, the awning fabric is stapled into the channels, and a divider bead which is the subject of one aspect of the present invention is then driven into one of the two edge channels of each section. The individual sections are then transported to the job site, where they are affixed to the buildings or structures for which they have been constructed. The sections are positioned such that the end of a first section, containing a preinserted divider bead, is directly opposite the end of an adjacent second section, without a divider bead. Upon positioning the sections together in abutment, the divider bead is located in the edge channel of the second section and then the adjacent rails are attached together. Upon positioning of all the divider beads, the impression is created that all the sections of awning assembly are actually a one-piece continuous assembly.

The presence of the divider bead between adjacent sections of awning assemblies protects these areas from mositure caused by inclement weather or other forces, such as, for example, a garden hose used to clean the building to which the awning is affixed. If such moisture was permitted to contact the awning fabric within the channels or the staples used to affix this fabric to the aluminum frame, the possibilities of deterioration would greatly increase.

Therefore, it is an object of the present invention to provide an improved awning frame assembly and method which has a water tight seal between awning frame sections and prevents moisture leakage between awning frame sections.

It is another object of the present invention to provide a method and assembly for joining two or more awning frame sections together at a job site, with minimal additional work required at the job site, such that the final assembled awning appears as a continuous awning and is also waterproof between sections.

It is another object of this invention to provide a divider bead for creating the aesthetic impression that numerous adjacent sections of awning are actually one continuous unit.

It is a further object of this invention to provide a joint between adjacent prefabricated sections of an awning assembly such that only one divider bead is required to adjoin the adjacent sections, and further such that the installation of additional fabric between the sections is not necessary.

It is a further object of this invention to provide a method for constructing an awning assembly whereby the gaps or joints between adjacent sections of the assembly may be bridged by a divider bead which creates the impression that the sections are actually one continuous unit.

It is a further object of this invention to provide a divider bead for protecting both the awning fabric and the staples by which this fabric is attached to an aluminum frame from moisture.

Other objects, features, and advantages of the present invention will become apparent upon reading the following specification when taken in conjunction with the accompanying drawings.

BRIEF DESCRIPTION OF THE DRAWINGS

FIG. 4 is a perspective view of two adjacent sections of the fabric awning assembly embodying the present invention prior to affixation to a building.

FIG. 6 is a perspective view of two adjacent sections of a fabric awning assembly joined as in the prior art.

DETAILED DESCRIPTION OF THE PREFERRED EMBODIMENT

Figure 1:
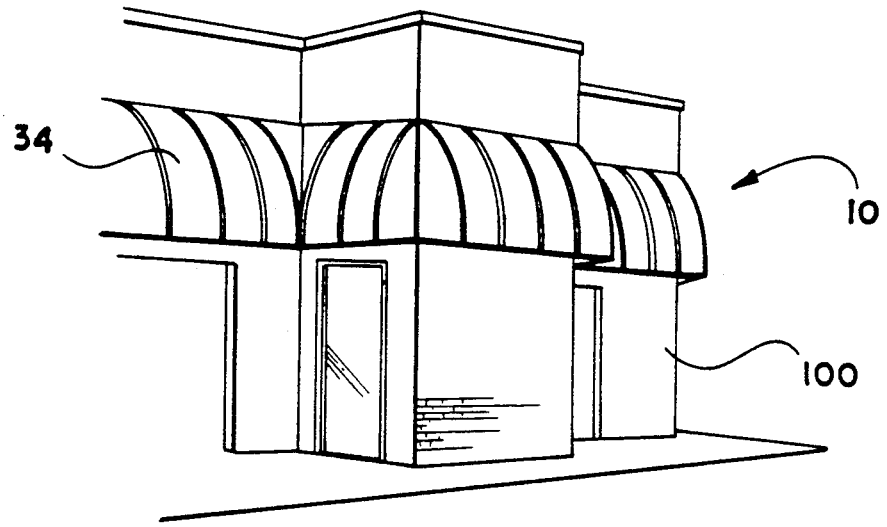
FIG. 1 is a perspective view of a building with the fabric awning assembly embodying the present invention affixed thereto.
Figures 2, 3:
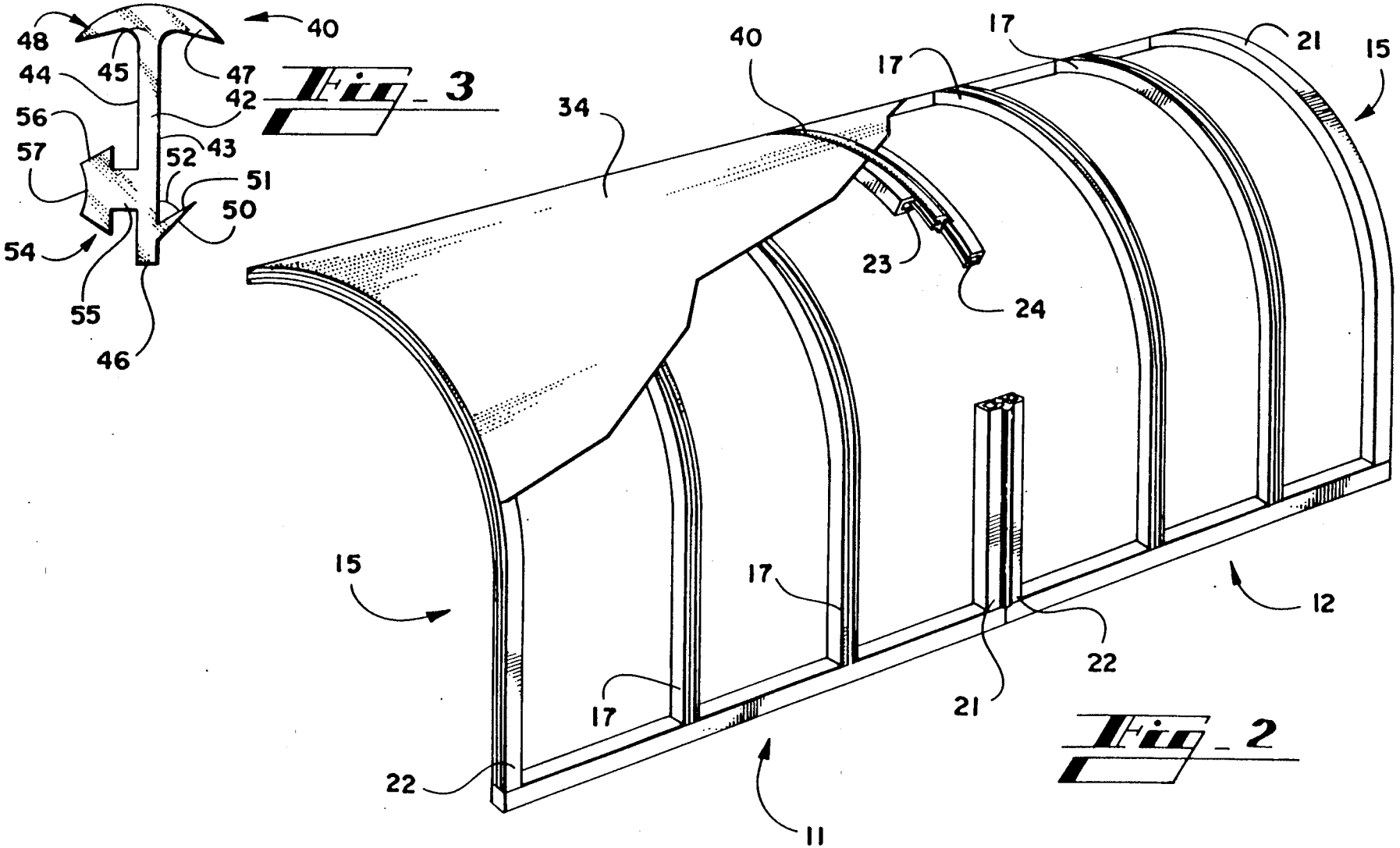
FIG. 2 is a partial cutaway perspective of the preferred embodiment of the present invention.
FIG. 3 is a cross-sectional pictorial view of the divider bead of the preferred embodiment of the present invention.

Turning now to the drawings, in which like numerals represent like parts throughout the several views, FIGS. 1 and 2 show a fabric awning assembly 10 embodying the present invention. The fabric awning assembly 10 has at least two adjacent sections 11, 12. The sections 11, 12 are constructed of a number of awning frame extrusions or rails 17, including edge rails 21, awning fabric strips 34, and beads 38, 40. The rails 17 and 21 are attached together to form a frame 15 of each section 11, 12 of the fabric awning assembly 10. Each frame 15 is constructed as follows. In the work place (not pictured), a plurality of aluminum rails 17 are attached to one another in a predetermined configuration by fastening means known in the art, such as welding or bolting. Part of this configuration includes placing an edge rail 21 at the left and right ends of each frame 15. Each rail 17 includes a staple receiving channel 19, and each edge rail 21 includes a staple receiving edge channel 23.

The design of the awning frame extrusions 17 is the subject of a prior design patent application, U.S. Ser. No. 253,724, by the same inventor as the present invention, the disclosure of which is incorporated herein by reference and made a part hereof.

The rails 17 in the center of the frame 15 are arranged such that the staple receiving channels 19 face upward, in such a position as to directly contact the awning fabric 34 when the awning fabric 34 is stretched over the assembled frame 15. The edge rails 21, in contrast, are arranged such that the staple receiving edge channels 23 face outward, as is best illustrated in FIGS. 4 and 5.

Figure 5:
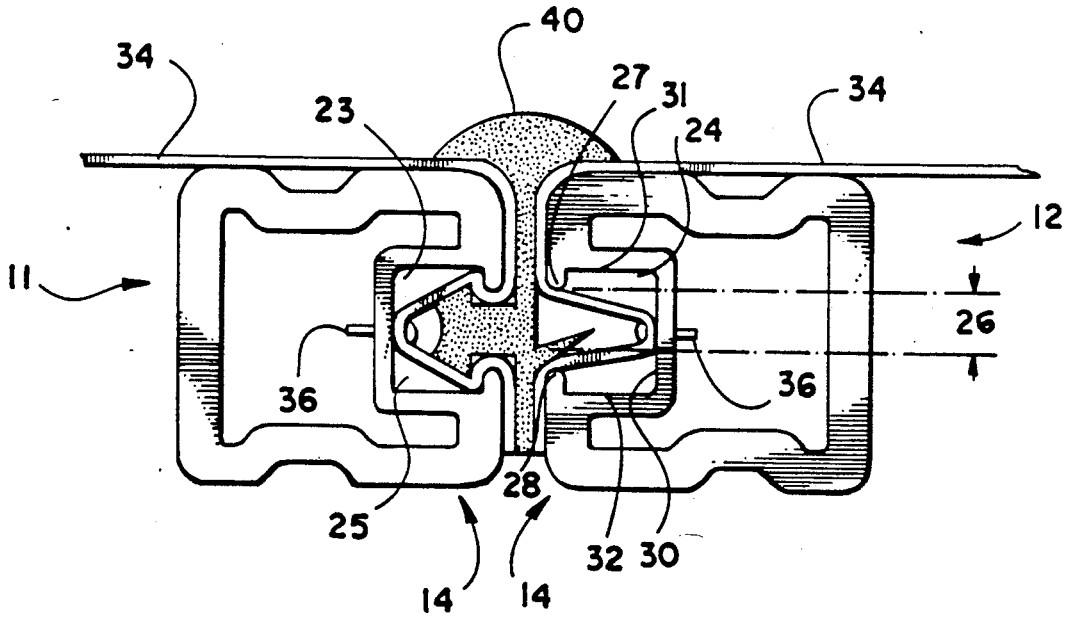
FIG. 5 is a cross-sectional pictorial view of two adjacent sections of the fabric awning assembly embodying the present invention subsequent to affixation to a building.

After assembly of the frame 15, the awning fabric 34 is stretched tautly over the frame 15 and secured thereto by the injection of staples 36, pictured in FIGS. 4 and 5, through the awning fabric 34 and into the staple receiving channels 19 and the staple receiving edge channels 23. To hide the staples 36 fastened into the staple receiving channels 19 from view, aesthetic mounting beads 38 of the type shown in FIG. 6 are driven into the staple receiving channels 19.

After the awning fabric 34 is affixed to the assembled frame 15, a divider bead 40, shown in detail in FIG. 3 and described in detail below, is driven into one staple receiving edge channel 23 in each section 11, 12, either in the work place or at the job site.

Once the sections 11, 12 are fully assembled, they are mounted to a building 100 or other structure for which they have been constructed. Adjacent sections 11, 12 are mounted in such an arrangement that a staple receiving edge channel 23 of an edge rail 21 of a section 11, into which a divider bead 40 has been driven, directly faces a staple receiving edge channel 24 of an edge rail 22 of an adjacent section 12, into which a divider bead 40 has not been driven, a relationship which is illustrated in FIGS. 4 and 5, discussed below. Once the two adjacent sections 11, 12 are mounted on the building 100 or other structure, the divider bead 40 creates a joint 14 between the two adjacent sections 11, 12, and the two adjacent sections 11, 12 appear to be one continuous assembly. The two adjacent sections 11, 12 are then secured together be inserting a bolt 13 through a hole (not pictured) drilled through the adjacent sections 11, 12 and the divider bead 40 prior to mounting and fastening the bolt 13 with a nut 18. It should be understood that the arrangement of adjacent sections 11, 12 may be reversed such that the divider bead 40 is driven into section 12 rather than section 11.

The fabric awning assembly 10 embodying the present invention is an improvement over the prior art awning assembly 60, illustrated in FIG. 6. In the prior assembly 60, the staple receiving channels 66 of the end rails 63, 64 of each section 61, 62 face upward, similar to the positioning of the staple receiving channels 19 of the fabric awning assembly 10 embodying the present invention. Upon affixation of the sections 61, 62 to the building (not pictured), an additional piece of fabric 68 is installed between the strips of fabric 67, 69 previously secured to the adjacent sections 61, 62. Aesthetic mounting beads 65 are driven into each of the staple receiving channels 66 to conceal the staples (not pictured) used to fasten the awning fabric 67, 68, and 69 to the sections 61, 62. The adjacent sections are held together by an elongate bolt 75, which is anchored by a nut 74. Unlike the fabric awning assembly 10 embodying the present invention, wherein only one divider bead 40 (pictured in FIG. 3) is necessary, two aesthetic mounting beads 65 are required at the location where adjacent sections 61, 62 of the assembly 60 abut one another, along with the additional strip of awning fabric 68 fastened in between the adjacent sections 61, 62 of the assembly.

Turning now to FIG. 3, it may be seen that the divider bead 40 comprises an elongate central shank 42, an elongate top member 47, a lip 50, and a support block 54. These components of the divider bead 40 are preferably integrally formed from a single extruded piece of a suitable plastic material, such as polyvinyl chloride (PVC). The central shank 42 has two side surfaces 43, 44, a top edge 45, and a bottom edge 46. The top member 47 has an outwardly facing convex surface 48 which is positioned distally from the top edge 45 of the central shank 42, to which the top member 47 is joined.

The convex surface 48 is the portion of the divider bead 40 which spans the joint 14 (pictured in FIG. 5) between adjacent sections 11, 12 of the fabric awning assembly 10 embodying the present invention. The convex surface 48 is the only portion of the divider bead 40 which is visible to those viewing the entire awning assembly 10 embodying the present invention from above.

The lip 50 extends outwardly from one side surface 44 of the central shank 42, intermediate the top edge 45 and the bottom edge 46 of the central shank 42, at an upward angle 52 of approximately 35 degrees. The upward extension of the lip 50 creates a gutter 51 which prevents the pooling of moisture, from inclement weather or other forces, on and around the staples 36, illustrated in FIGS. 4 and 5, and the portion of awning fabric 34 within the staple receiving edge channels 23, illustrated in detail in FIGS. 4 and 5.

The support block 54 extends outwardly from the other side surface 43 of the central shank 42, also intermediate the top edge 45 and the bottom edge 46 of the central shank 42. The support block comprises a generally T-shaped tab having a stem 55, which is attached to the central shank 42, and a cross member 56. The cross member 56 of the support block 54 has an outwardly facing concave surface which is positioned distally from the central shank. The support block 54 helps to secure the awning fabric 34 within one of the staple receiving edge channels 23. The awning fabric 34 stretches around the cross member 56 of the support block, making the part of the awning fabric 34 within the staple receiving edge channel 23 more taut.

Turning now to FIGS. 4 and 5, the relationship between two adjacent sections 11, 12 of the fabric awning assembly 10 embodying the present invention and the divider bead 40, which forms the joint 14 between the adjacent sections 11, 12, is illustrated. During assembly of the sections 11, 12, discussed in detail above, a divider bead 40 is driven into one end of each section 11, 12, and the sections 11, 12 are arranged such that a staple receiving edge channel 23 of an edge rail 21 of a section 11, into which a divider bead 40 has been driven, directly faces a staple receiving edge channel 24 of an edge rail 22 of an adjacent section 12, into which a divider bead 40 has not been driven. The staple receiving edge channels 23, when viewed in a cross section such as in FIG. 5, define a recess 25. The recess 25 is bounded on three sides by a back surface 30, a top surface 31, and a bottom surface 32. The recess has an opening 26 which is partially blocked by a top tooth 27 and a bottom tooth 28. The top tooth 27 extends laterally downward from an edge of the top surface 31 opposite the intersection of the top surface 31 and the back surface 30, and the bottom tooth 28 extends laterally upward from an edge of the bottom surface 32 opposite the intersection of the bottom surface 32 and the back surface 30.

The cross member 56 of the support block 54 of the divider bead is wider than the opening 26 between the top tooth 27 and bottom tooth 28, so when the divider bead 40 is driven into the staple receiving edge channel 23, the top tooth 27 and bottom tooth 28 prevent the cross member 56 from disengaging the staple receiving edge channel 23 by falling through the opening 26.

When the adjacent sections 11, 12 of the fabric awning assembly 10 embodying the present invention are affixed to the building 100 (pictured in FIG. 1), the lip 50 of the divider bead 40 extends into the recess 25 of the staple receiving channel 24 into which the divider bead 40 has not been driven. In their final, mounted arrangement, the adjacent staple receiving edge rails 21, 22 and the divider bead 40 form the joint 14.

While this invention has been described in detail with reference to the preferred embodiment thereof, it will be understood that variations and modifications can be made within the spirit and scope of the invention as described here and above and defined below in the appended claims.

What is claimed is:

1. A flexible, water-impervious divider bead for forming a seal between adjacent sections of an awning assembly, comprising:

an elongate central shank including opposite side surfaces, a bottom edge and a top edge;

an elongate top member positioned along said top edge and extending outwardly beyond both of said side surfaces of said shank;

a first protrusion extending outwardly from one side surface of said shank intermediate said edges of said shank and including an elongate lip extending outwardly from one side surface of said shank so as to define an upwardly opening gutter capable of directing a flow of moisture along said gutter; and a second protrusion defining an elongate support block extending outwardly from the other side surface of said central shank, for being retained by one of said awning sections.

2. The divider bead of claim 1, wherein said top member has an outwardly facing convex surface positioned distally from said top edge of said central shank.

3. The divider bead of claim 1, wherein said lip extends upwardly from said central shank at an angle of about 35 degrees.

4. The divider bead of claim 1, wherein said support block defines a generally t-shaped tab having a stem attached to said central shank and a cross member.

5. The divider bead of claim 4, wherein said cross member has an outwardly facing concave surface positioned distally from said central shank.

6. The divider bead of claim 1, wherein said protrusion comprises an elongate support block extending outwardly from said central shank, said support block being capable of being retained by one of said awning sections.

7. The support block of claim 6, wherein said support block defines a generally t-shaped tab having a stem attached to said central shank and a cross member.

8. The support block of claim 7, wherein said cross member has an outwardly facing concave surface positioned distally from said central shank.

9. The divider bead of claim 1, wherein said adjacent awning sections define first and second staple receiving edge channels into which one of said protrusion extends.

10. A method for assembling adjacent sections of a fabric awning assembly of the type in which awning fabric is stapled in staple receiving channels formed in rails supporting the awning fabric, comprising the steps of:

constructing frames of said sections by attaching a plurality of aluminum rails to one another in a predetermined configuration such that a staple receiving edge channel in a rail at a peripheral edge of each of said sections faces laterally outwardly with respect to the plane of said fabric awning;

affixing strips of awning fabric to outside surfaces of said frames by stapling said fabric in said staple receiving edge channels;

installing a divider bead within a first one of said staple receiving edge channels; and positioning a first one of said sections adjacent to a second one of said sections of said fabric awning assembly such that said first staple receiving edge channel directly faces a second one of said staple receiving edge channels; and such that at least one protrusion of said divider bead extends into either said first or said second staple receiving edge channel.

11. The method of claim 10, further comprising the step of joining together said rails containing said first and second staple receiving edge channels.

12. The method of claim 10, wherein said staple receiving edge channels define in a cross section a recess, the opening of which is partly blocked by top and bottom teeth extending toward one another from opposite sides of said opening.

13. The method of claim 10, wherein said recess is generally rectangular in cross section, and is bounded on three sides by a back surface, a top surface, and a bottom surface.

14. The method of claim 13, wherein said top tooth extends laterally downward from an edge of said top surface directly opposite the intersection of said back surface and said top surface, and said bottom tooth extends laterally upward from an edge of said bottom surface directly opposite the intersection of said back surface and said bottom surface.

15. The method of claim 14, wherein said extensions of said front top tooth and said front bottom tooth define the opening of said recess, whereby said protrusion of said divider bead is capable of being positioned within and supported by said staple receiving edge channel and retained therein by said teeth.

16. The method of claim 15, wherein said protrusion comprises an elongate support block extending outwardly from said central shank, said support block being capable of being retained by one of said awning sections.

17. The support block of claim 16, wherein said support block defines a generally t-shaped tab having a stem attached to said central shank and a cross member.

18. The support block of claim 17, wherein said cross member has an outwardly facing concave surface positioned distally from said central shank.

19. The support block of claim 18, wherein said recess is narrower than the length of said cross member such that when said support block is snapped into either said first or said second staple receiving edge channel, said cross member will be unable to become disengaged from said staple receiving edge channel.

20. A joint for linking adjacent prefabricated sections of an awning assembly, comprising:

a pair of rails, each positioned along a peripheral edge of one of said sections and each defining a staple receiving edge channel facing laterally outwardly with respect to the plane of said awning assembly;

a pair of fabric strips extending around said rails and secured to said rails by being stapled into said staple receiving edge channels;

a divider bead shaped to extend between said rails and into at least one of said staple receiving edge channels; and means for retaining said rails adjacent to one another with said divider bead therebetween.

21. The joint of claim 20, wherein said prefabricated sections comprise:

a plurality of aluminum rails, each defining staple receiving channels, attached to one another in a predetermined configuration; and awning fabric stretched across said rails and stapled in each of said staple receiving channels.

22. The joint of claim 20, wherein said divider bead comprises:

an elongate central shank including opposite side surfaces, a bottom edge and a top edge;

an elongate top member positioned along said top edge and extending outwardly beyond both of said side surfaces of said shank; and at least one protrusion extending outwardly from one side surface of said shank intermediate said edges of said shank.

23. A fabric awning assembly system, comprising a plurality of awning sections connected to adjacent awning sections by the joint of claim 20.

* * * * *